United States Patent [19]

Flory

[11] Patent Number: 4,942,506

[45] Date of Patent: Jul. 17, 1990

[54] ELECTRICAL LIGHT ILLUMINATION FOR KITES FLOWN AT NIGHT

[76] Inventor: Mark T. Flory, 7214 Gaston, #219, Dallas, Tex. 75214

[21] Appl. No.: 309,190

[22] Filed: Feb. 13, 1989

[51] Int. Cl.[5] ..... A63H 27/08

[52] U.S. Cl. ..... 362/253; 244/155 R

[58] Field of Search ..... 362/253, 800, 806; 244/153 R, 153 A, 155 R; 446/47, 485

[56] References Cited

U.S. PATENT DOCUMENTS

| | | | |
|---|---|---|---|
| 2,494,430 | 1/1950 | Carnwath | 244/153 A |
| 2,632,614 | 3/1953 | Bodell | 244/153 R |
| 2,750,136 | 6/1956 | Stracke, Jr. | 244/155 R |
| 3,786,246 | 1/1974 | Johnson et al. | 244/155 R |
| 4,173,035 | 10/1979 | Hoyt | 362/806 |
| 4,308,572 | 12/1981 | Davidson et al. | 362/800 |
| 4,480,293 | 10/1984 | Wells | 362/800 |
| 4,570,206 | 2/1986 | Deutsch | 362/800 |
| 4,602,191 | 7/1986 | Davila | 362/800 |
| 4,774,642 | 9/1988 | Janko et al. | 362/800 |
| 4,778,428 | 10/1988 | Wield | 446/485 |

*Primary Examiner*—Stephen F. Husar
*Assistant Examiner*—Richard R. Cole

[57] ABSTRACT

A kite equipped with lights powered by a power source such as a battery carried by the kite. The lights may be mounted along outline framing of the kite or in a field of lights controlled by a program unit carried by the kite settable for different programmed collective light designs in various desired configurations. Kite lighting systems are to be made up as kits mountable on kites of most any kite design to provide an interesting light display from a kite flown in the dark of night.

9 Claims, 2 Drawing Sheets

ELECTRICAL LIGHT ILLUMINATION FOR KITES FLOWN AT NIGHT

Figure 1:
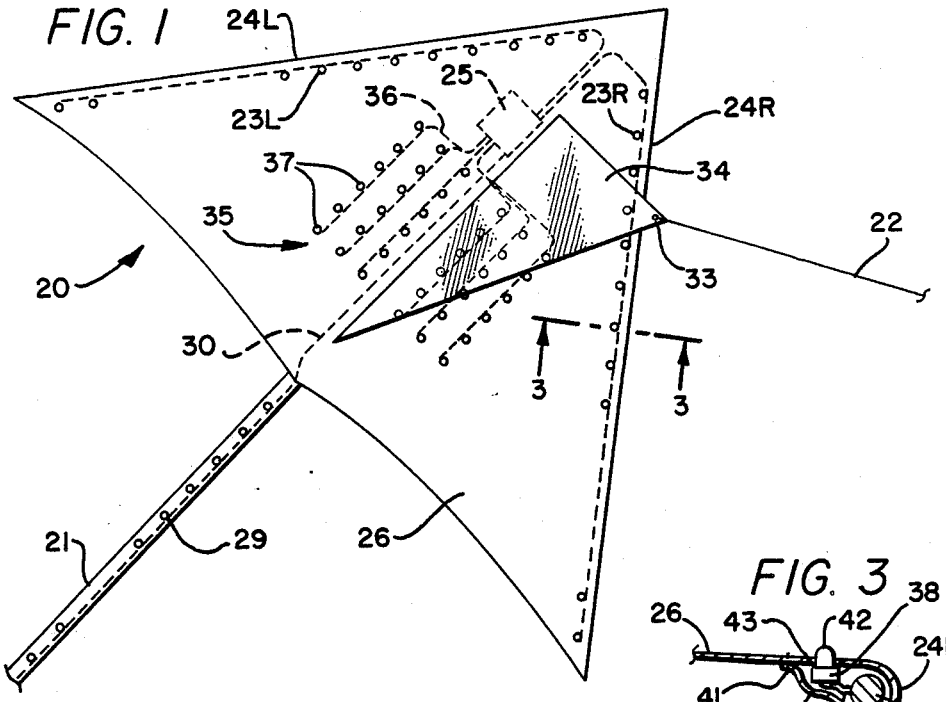

This invention relates in general to kites that are flown in the wind on strings from the ground, and more particularly, to kites equipped with lights in a lighting system including battery power, circuit closing switch and a programmer for controlling successive varying light patterns from an area of display lights.

Through the years, even through hundreds of years, there have been countless kite design configurations primarily designed for flight during daytime hours. These kites are generally drawn in as the hours of darkness approach since the flying kite can no longer be seen with a kite string extending out and up into the darkness. With lights mounted on a kite along with a kite carried power supply kite flying takes on a new dimension with lighted lights on a kite viewable in the hours of darkness from the ground. This is quite an attention getter and an interesting sight to many viewers with the impressions from kite light nighttime viewing being quite different from daytime kite flying.

It is therefore a principal object of this invention to provide kites with kite mounted light systems for lights on a kite to be viewed in the nighttime hours of darkness.

Another object is to provide a light system on a kite with lights controlled in various patterns for enhanced interest in viewing.

A further object is to provide such a kite system capable of displaying messages.

Still another object with such a kite light system is to provide radio control selection of light displays.

Features of the invention useful in accomplishing the above objects include, in an electric light system equipped kites for light enhanced viewing during hours of darkness at night, a kite equipped with lights powered by a power source such as a battery carried by the kite. The lights may be mounted along outline framing of the kite or in a field of lights controlled by a program unit carried by the kite settable for different programmed collective light designs in various desired configurations. Kite lighting systems are to be made up as kits mountable on kites of most any kite design to provide an interesting light display from a kite flown in the dark of night. A radio control link is provided with some embodiments for kite light and/or message control from the ground.

Specific embodiments representing what are presently regarded as the best modes of carrying out the invention are illustrated in the accompanying drawings.

Figure 3:
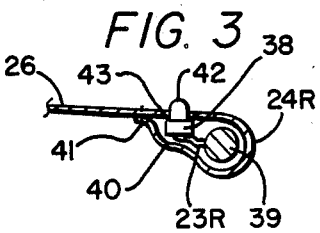
Figure 2:
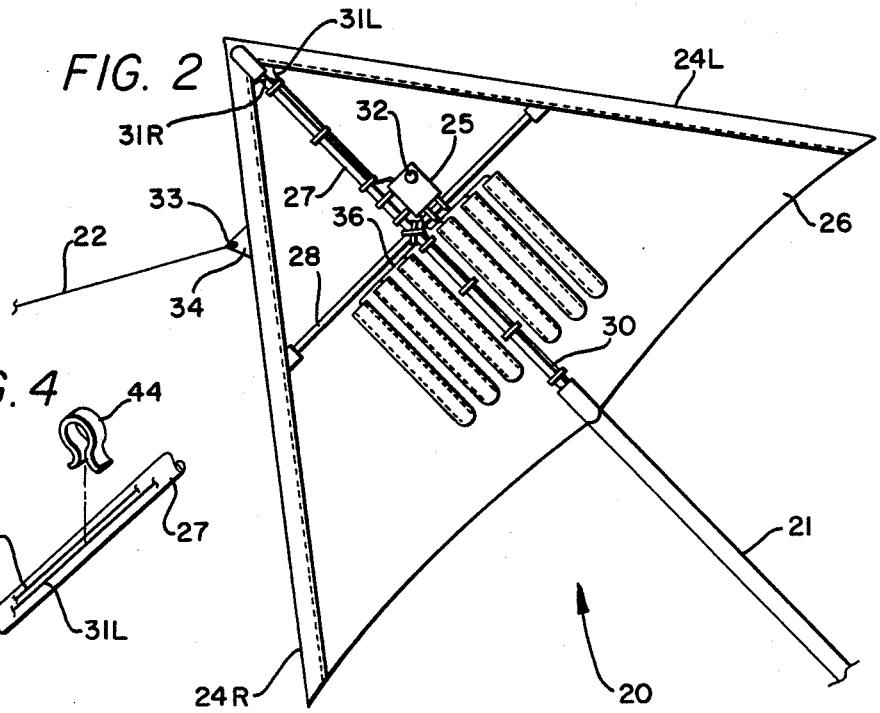
Figure 4:
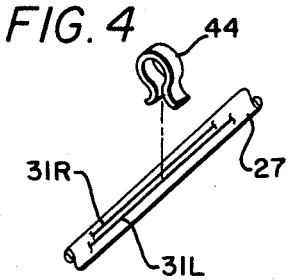
Figure 5:
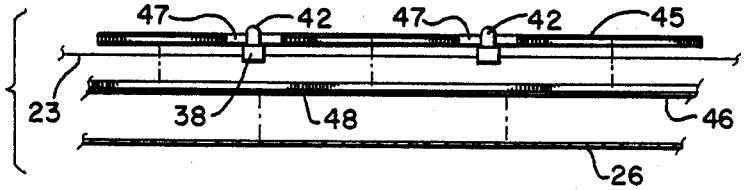
Figure 6:
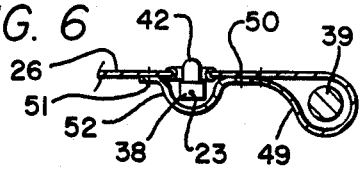
Figure 7:
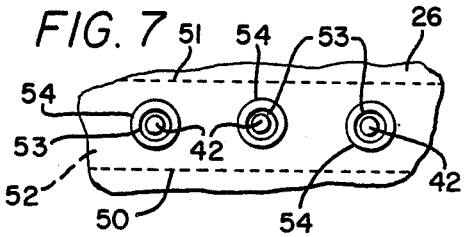
Figure 8:
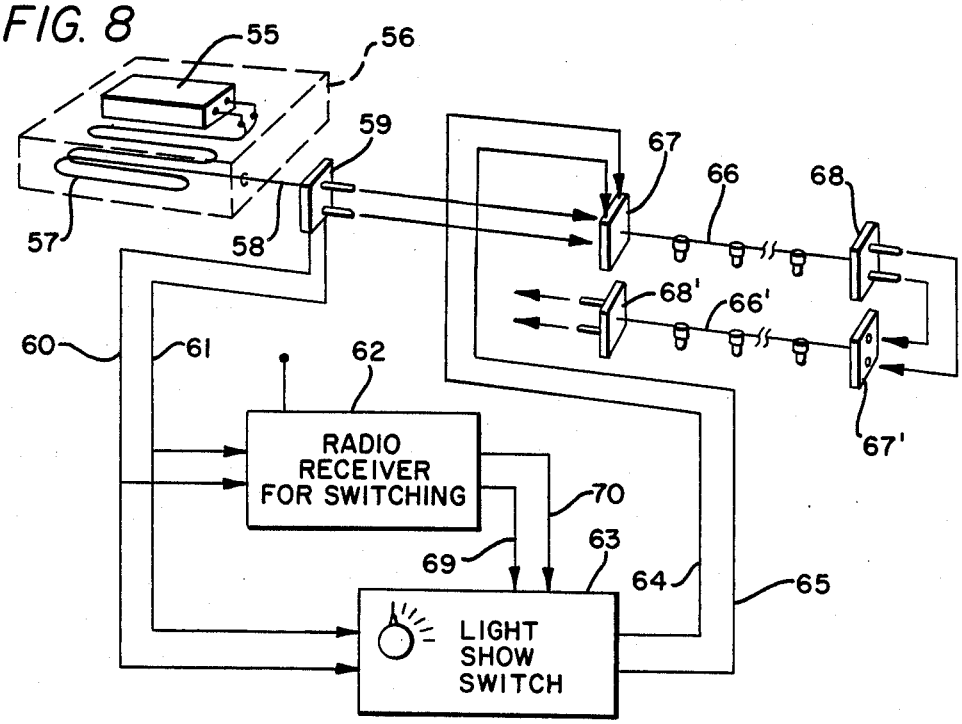
Figure 9:
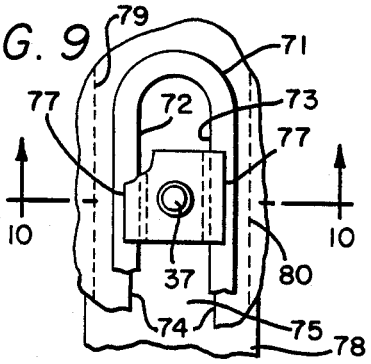
Figure 10:
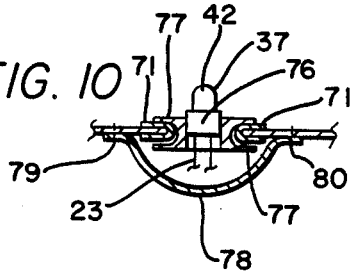

In the drawings:

FIG. 1 represents a perspective view of a triangularly shaped flying kite having a tail and equipped with a lighting system for night flying;

FIG. 2, a reverse top perspective view of the kite of FIG. 1, showing additional kite and kite lighting system detail;

FIG. 3, a partially cut away and sectioned view taken generally along line 3—3 of FIG. 1 showing kite edge frame and light mounting detail;

FIG. 4, a fragmentary showing of a kite frame member and a clip mountable for holding lighting system wires on the frame member;

FIG. 5, a fragmentary exploded view of a kite lighting system light and wire circuit mounting with Velcro interlocking material mounted on a kite;

FIG. 6, a cut away and sectioned view of light system mounting detail near a kite edge dowel;

FIG. 7, a view of part of the kite portion of FIG. 6 with lights extended through openings in the kite surface;

FIG. 8, a block schematic of a kite light system mountable on a kite to show lighting on the kite during hours of darkness;

FIG. 9, a plan view of a flexible track in an elongate opening in fabric of a kite along which lamo socket slides mounting individual lights are moveable; and FIG. 10, a cut away and sectioned view taken along line 10—10 of FIG. 9 showing detail of the flexible track in a kite opening with a lamp mounted in the lamp socket slide.

Referring to the drawings:

The kite 20 of FIGS. 1 and 2 is shown to be a triangular kite, equipped with a tail 21 in a conventional manner, and flown from a string 22 extended to the ground. Strings of lights 23L and 23R are shown to be mounted along and inboard of kite opposite side edges 24L and 24R connected to a battery power package 25 mounted on the kite above the kite fabric 26 adjacent to the intersection of the kite center frame (or dowel) member 27 and kite cross frame member 28. Another string of lights 29 fastened to the kite tail 21 is connected to the battery power package 25, via wire cable 30, that has wire cables 31L and 31R extended to light strings 23L and 23R. The battery power package 25 is shown to have a knob switch 32 by which power could be selectively turned on to one or another or all the light strings mounted on the kite. In an alternate approach the light system is activated by plug connecting the light strings to a battery or battery package. String 22 is fastened to the bottom apex 33 of triangular material 34 interconnecting the string 22 and the center frame member 27 area of the kite 20. Please note that the triangular material 34 is made of transparent plastic if variable display light field 35 is mounted in the center of the kite 20 so as to not obscure light display emissions from the light field 35. Multi-line lighting cable 36 extends from battery power package 25 that also includes computerized control for varied activation of lights 37 in the light field 35 for time varied light displays. Referring also to FIG. 3, individual light 38 mounting detail is shown for light string 23R adjacent kite edge dowel 39 about which the kite fabric 26 is folded over to an underlying flap extension 40 that is stitched 41 in place backing up the lights 38 with bulbs 42 extending through openings 43 in the kite fabric 26. The fragmentary showing of FIG. 4 illustrates a resilient plastic (or metal) clip 44 used to clamp wire cables 31L and 31R and other cables to the center frame spar 27.

Referring to FIG. 5, opposite interlocking sheets 45 and 46 of material (such as velcro) are used to mount lights 38 of a light string 23 with bulbs 42 extended through openings 47 in interlocking material sheet 45 and the wire cable of the light string 23 held between the interlocking sheets 45 and 46. The back side of sheet 46 has a layer of adhesive 48 for mounting attachment to kite fabric 26.

FIGS. 6 and 7 show an alternate light 38 and light string 23 mounting structure with extended fabric flap 49 turned over kite edge dowel rod 39 and fastened by stitching 50 and 51 to form an elongate pocket 52 with the kite fabric 26. Pocket 52 holds a light string 23 with light bulbs 42 extended through openings 53 with reinforcing rings 54.

In the kite night lighting system of FIG. 8, a low voltage battery power source 55 is contained within a box 56 that provides for the storage of excess wire cable 57 that has an outlet extension 58 terminated by male plug 59. Lines 60 and 61 extend from plug 59 to a radio receiver 62 that is activated by a ground transmitter for switching control of light show switching computer 63 that has output connections 64 and 65 to light string 66 with connectors 67 and 68. Additional light strings 66' with connectors 67' and 68' are serially connectable to the first light string 66. Connector 67 may be directly connected to male plug 59 for direct power operation of light string 66 and additional light strings 66' if serially connected thereto for direct lighting. Cable lines 69 and 70 connect the output of radio receiver 62 to the light show computer control switch 63. Lines 60 and 61 in addition to connection with radio receiver 62 extend on to power input connection with the control switch computer 63.

FIGS. 9 and 10 show still another light 37 and light string 23 mounting system with a flexible track 71 having opposite sides 72 and 73 enclosing fabric opening edges 74 of openings 75 in the kite fabric 26. Lamp socket units 76 are slide mounted with opposite side channel portions 77 enclosing track opposite slide sides 72 and 73 for slide positioning of lights 23 with bulbs 42 exposed to the underside of the kite 20. Fabric channel enclosures 78 stitched 79 and 80 on opposite sides enclose the flexible track 71 and the strings of lights 23 from the kite top.

The light systems shown could not only be mounted on bat kites 20, as shown, but box kites as well, and any number of different size and kite shapes that are available. An alternate power source in place of battery power could be wind driven electric power generators mounted on kites as part of the lighting system carried by a kite.

Whereas this invention has been described with respect to several embodiments thereof, it should be realized that various changes may be made without departing from the essential contributions to the art made by the teachings hereof.

I claim:

1. An electric light illumination system for kites flown in the hours of darkness at night comprising: kite mounted electrical power source; lighting means mounted on the kite; circuit means connected to said lighting means; and interconnect means for selectively connecting said circuit means to said kite mounted electrical power source; wherein said lighting means includes a plurality of electric lights in said circuit means; said interconnect means includes a switching structure capable of switching electric power to lights of said plurality of lights; said switching structure is connected to, and controlled by, computer control means; and wherein a radio receiver is included in the system mounted on a kite connected to said switching structure.

2. The electric light illumination system for kites of claim 1, wherein said system is supplied in kit form for mounting on any of a great variety of kites flown on a string from the ground.

3. The electric light illumination systems for kites of claim 1, wherein said plurality of electric lights in said circuit means includes a light field of multiple lights connected to, and controlled by, said computer control means for providing serially, various displays as called for by computer control; and wherein a radio receiver is included in the system mounted on a kite connected to said computer control means for radio control of said computer for various programmed light field control sequences desired.

4. The electric light illumination system for kites of claim 1, wherein the kite includes kit fabric having an upper side and a ground facing underside; individual lights are mounted on the upper side of the kite to extend through openings in said kite fabric for the lights to shine on the underside of said kite fabric.

5. The electric light illumination system for kites of claim 4, wherein openings in said kite fabric include a flexible track having opposite sides enclosing fabric opening edges of openings in the kite fabric; and individual lamp socket units with opposite side channel portions slidably enclosing opposite sides of the flexible track for slide positioning of lights therealong.

6. The electric light illumination system for kites of claim 5, wherein fabric channel enclosures are provided on the upper side of said kite fabric over said flexible tracks.

7. The electric light illumination system for kites of claim 1, wherein interlocking sheets of material are used to mount lights and light string wire cables with lights extended through openings in one interlocking sheet; and the other interlocking sheet having a layer of back adhesive for mounting to a ground facing underside of fabric of the kite.

8. An electric light illumination system for kites flown in the hours of darkness at night comprising: a kite mounted electrical power source; lighting means mounted on the kite; circuit means connected to said lighting means; and interconnect means for selectively connecting said circuit means to said kite mounted electrical power source; wherein said kite mounted electrical power source is a battery power source; said lighting means includes a plurality of electric lights in said circuit means; said interconnect means includes a switching structure capable of switching electric power to lights of said plurality of lights; said switching structure is connected to, and controlled by, computer control means; and wherein a radio receiver is included in the system mounted on a kiter connected to said switching structure and to said computer control means.

9. The electric light illumination system for kites of claim 8, wherein said system is supplied in kit form for mounting on any of a great variety of kites flown on a string from the ground.

* * * * *